US012687006B2

(12) United States Patent
Nuriev

(10) Patent No.: US 12,687,006 B2
(45) Date of Patent: Jul. 21, 2026

(54) SPACE FRAME

(71) Applicant: Ildar Vazyhovich Nuriev, Nizhnekamsk (RU)

(72) Inventor: Ildar Vazyhovich Nuriev, Nizhnekamsk (RU)

( * ) Notice: Subject to any disclaimer, the term of this patent is extended or adjusted under 35 U.S.C. 154(b) by 187 days.

(21) Appl. No.: 18/624,958

(22) Filed: Apr. 2, 2024

(65) Prior Publication Data

US 2024/0247479 A1 Jul. 25, 2024

Related U.S. Application Data

(63) Continuation of application No. PCT/RU2023/000022, filed on Jan. 27, 2023.

(30) Foreign Application Priority Data

Feb. 1, 2022 (RU) ..... RU2022102305

(51) Int. Cl.
*E04B 1/19* (2006.01)

(52) U.S. Cl.
CPC .... *E04B 1/1903* (2013.01); *E04B 2001/1933* (2013.01); *E04B 2001/1957* (2013.01)

(58) Field of Classification Search
CPC ..... E04B 1/1903; E04B 2001/1933; E04B 2001/1957; E04B 2001/1927; E04B 1/1906; E04B 1/19; E04B 1/58; E04B 2001/1942
See application file for complete search history.

(56) References Cited

U.S. PATENT DOCUMENTS 3,632,147 A * 1/1972 Finger ..... A47F 5/14 403/171
3,789,562 A 2/1974 De Chicchis et al.
3,921,360 A 11/1975 Baldwin
3,995,962 A 12/1976 Mylaeus
5,088,852 A * 2/1992 Davister ..... F16B 7/044 403/171
5,265,395 A * 11/1993 Lalvani ..... E04B 1/32 403/176
5,713,686 A * 2/1998 Maughan ..... F16B 7/06 403/46

(Continued)

FOREIGN PATENT DOCUMENTS

DE 2436628 A1 4/1976
FR 2628461 A1 9/1989

(Continued)

*Primary Examiner* — Patrick J Maestri

(57) ABSTRACT

The invention relates to the field of building, and more particularly to a space frame, and can be used for creating wall structures, columns, supports, ceilings and complex dome structures for different purposes. The space frame comprises rods and polyhedral nodes with threaded apertures on the faces thereof for fastening said rods, wherein the rods have a tubular cylindrical shape and have an external thread on their ends, the diameter of the external thread of a rod corresponding to the diameter of a threaded aperture, and the space frame further comprises a coupling with an internal thread, capable of detachably connecting rods. The technical result is that of simplifying and expediting assembly by standardizing the component parts, while at the same time preserving the strength of the space frame.

6 Claims, 5 Drawing Sheets

(56) References Cited

U.S. PATENT DOCUMENTS

| | | | | |
|---|---|---|---|---|
| 6,672,789 | B2 * | 1/2004 | Chen | F16B 7/185 403/171 |
| 10,327,545 | B2 * | 6/2019 | McPhillips | A47B 47/0091 |
| 10,378,198 | B2 * | 8/2019 | Benthien | E04B 1/19 |

FOREIGN PATENT DOCUMENTS

| | | | |
|---|---|---|---|
| GB | 2131847 | A | 6/1984 |
| RU | 2577339 | C1 | 3/2016 |
| SU | 1636539 | A1 | 3/1991 |

* cited by examiner

SPACE FRAME

CROSS-REFERENCE TO RELATED APPLICATIONS

This application is a continuation of International Patent Application No. PCT/RU2023/000022, filed on Jan. 27, 2023, which claims the benefit of priority from Russian patent application Ser. No. 2022102305 filed on Feb. 1, 2022. The content of the aforementioned applications, including any intervening amendments thereto, are incorporated herein by reference.

FIELD OF INVENTION

The invention lies in the construction scope, in particular represents space frame, and can be used to build wall structures, columns, supports, slabs and complex domed structures of various purposes.

PRIOR ART

Nikiforov's structural composition, patented in the USSR under No. 1636539, IPC E04B 7/00, published 23 Mar. 1991, includes rod elements united in nodes with symmetrical angular orientation of axes. Upon that a maximum of fourteen core elements can be attached to each node, forming a hypothetical rhombic dodecahedron centered in the center of the node structure. The core elements are oriented along the axes of the rhombic dodecahedron in seven flow-through directions with a common intersection point in the center of the node.

The document describes the possibility of assembling structures of various shapes, but it lacks a description of the connection method or type between nodal and rod elements.

A space frame for buildings and structures with a nodal connection of rods of the MARHI (Moscow Institute of Architecture) system is also well-known (patent for invention RF No. 2577339, IPC E04B 1/58, published 20 Mar. 2016). It includes a nodal connection of rods of the MARHI system implemented through a polyhedral spherical or hemispherical nodal element with threaded holes to which the rods of the bar frame are connected. There are tips at the ends of the rods with a connecting holed element. A bolt with a sleeve is passed though a hole in the connecting element. There is a longitudinal groove on the outer surface of the bolt for contact, and a protrusion on the inner surface of the sleeve. Rotation of the sleeve and contact between the protrusion and the groove creates a rotational and reciprocating movement of the bolt towards the nodal element.

The drawbacks of this technical solution include a complex mechanism for joining the rod and nodal element, high labor costs for assembling and manufacturing such parts.

The closest equivalent is a spatial lattice frame intended for installing panels with various polygonal nodal points and rods (German invention U.S. Pat. No. 2,436,628, IPC E04B 1/19, published 8 Apr. 1976), comprising rods and nodal points and designed to facilitate complete filling by panels of the space between the rods. The nodal points for insertion are polyhedrons having faces including regular octagons, regular hexagons and squares; faces including hexagons and squares; and faces including octagons and squares. The cross-sectional areas of the rods coincide with the faces of these nodal points. Screw couplings inside the rod ends and threaded holes in the nodal points can be used for connection. It is possible to have a sealing element inside the rod.

The drawbacks of this technical solution include a complex mechanism for joining the rod and nodal element, high labor costs for assembling and manufacturing such parts. The invention features screws at the ends of the rod elements for fastening to the nodal element and requires the use of additional elements to secure the screw. Flow-through holes in the rods providing access to the screws result in weakened walls and reduced strength characteristics of the rod. Further, specialized tools are required to work with the screw. The invention lacks standardization of parts since it involves the use of multiple types of nodal elements with different planes and rods with different cross-sections in the plan.

DISCLOSURE OF THE INVENTION

The problem addressed by the claimed invention is to simplify the production of parts for a space frame, reduce the manpower effort to construction and installation works, and ensure universality for use in rod systems with different angles of rod junctions within one structure.

The technical result achieved by using the present invention is to simplify and accelerate assembly by standardizing parts while maintaining the strength of the space frame.

The technical result is achieved by the fact that the space frame includes rods and nodal elements of polyhedral shape with threaded holes on the faces for fastening the rods. Whereby the rods have a tubular cylindrical shape with external threads at the ends, where the diameter of the external thread matches the diameter of the threaded hole. Further space frame includes a sleeve with internal threads with internal thread, designed for detachable connection of the rods.

BRIEF DESCRIPTION OF DRAWINGS

The invention is further explained by the following drawings.

EMBODIMENTS OF THE INVENTION

Figure 1:
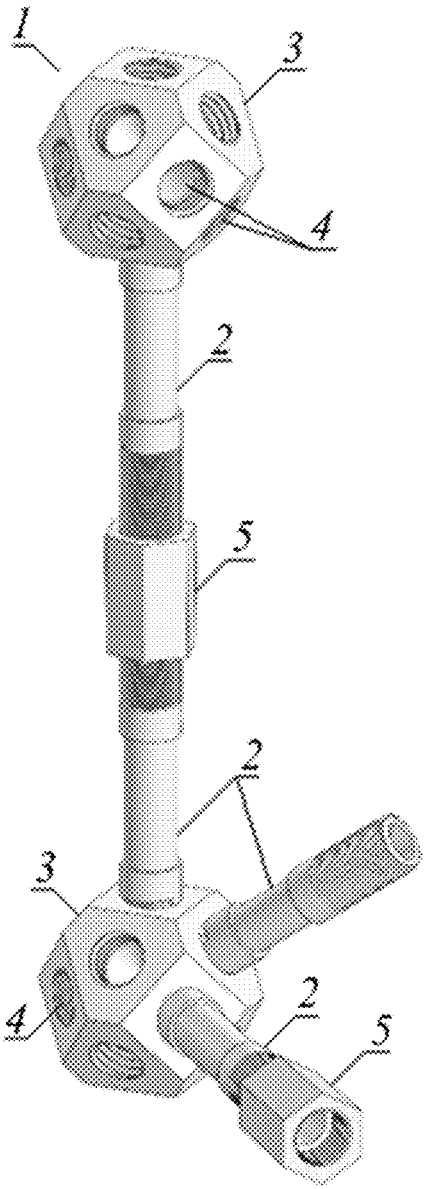
FIG. 1. General view of the space frame.

The space frame (1) comprises rods (2), nodal elements (3) with holes (4) for attaching the rods (2), and a sleeve (5) for sequentially connecting the rods (2). Hexagonal lock nuts for securing the sleeve (5) (FIG. 1) can be further included to the space frame (1).

The rod (2) of the space frame (1) is a hollow solid cylindrical tube. Both ends of the rod (2) have external threads for direct attachment to the nodal element (3).

Figure 2:
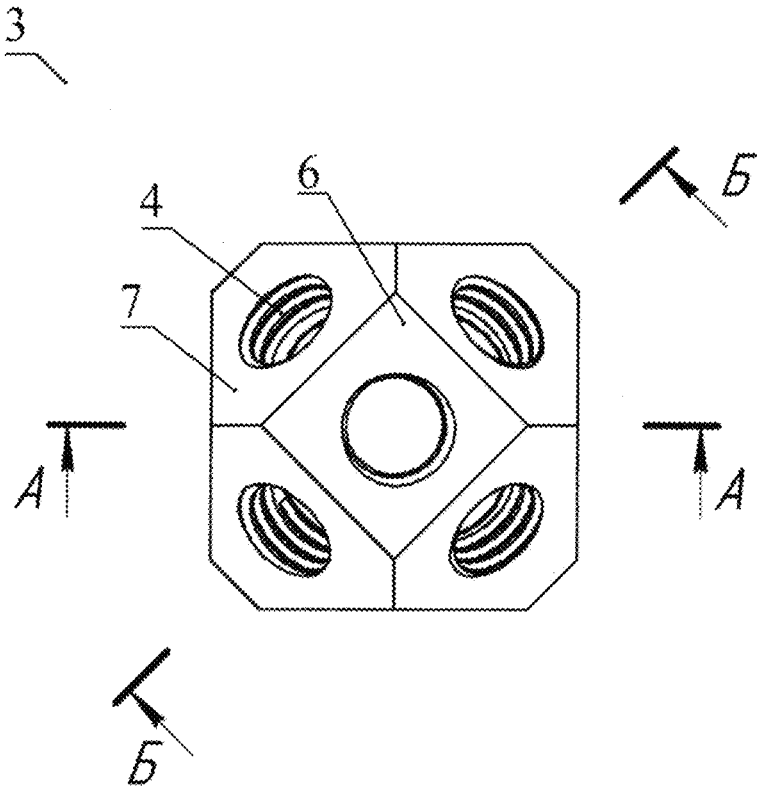
FIG. 2. General view of the nodal element.

The nodal element (3) of the space frame (1) is a polyhedral element derived from an octahedron or tetrahexahedron. The nodal element (3) has fourteen faces, six of which have the form of squares (6), and the remaining eight faces are in the form of hexagons (7) with equal angles and different side lengths. The sides length of the square (6) corresponds to the longest side of the hexagon (7) (FIG. 2).

Figure 3:
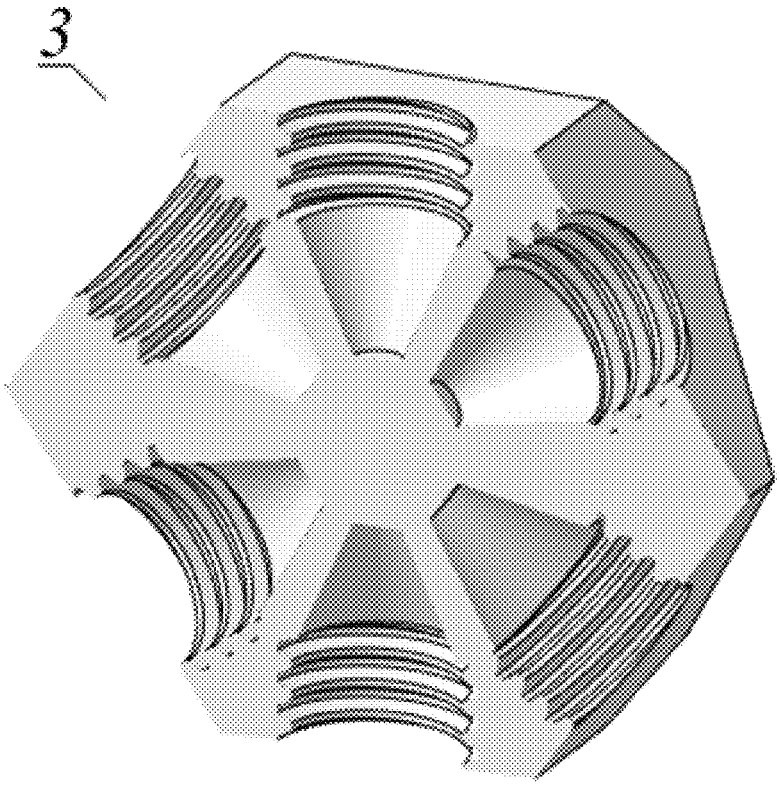
FIG. 3. Sectional view of the nodal element in the secant plane A-A.

On each of the faces there is a blind threaded hole for fixing rods (2). The hole (4) has a cylindrical threaded part to attach the rods and a truncated conical part. The truncated conical parts, remaining empty during rod installation, are designed to reduce weight and save materials. Threaded hole diameter (4) matches the diameter of the external thread of the rod (2) (FIG. 3).

Figure 4:
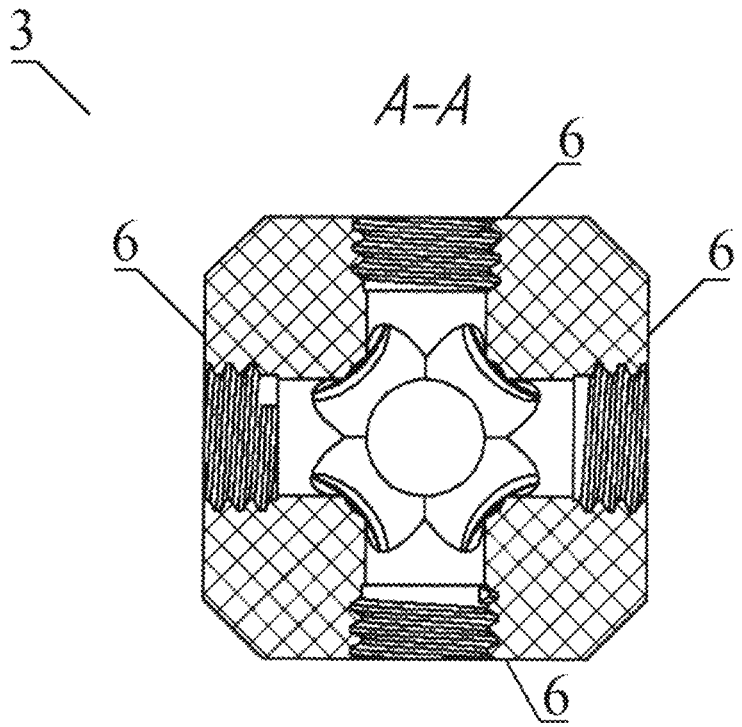
FIG. 4. Sectional view of the nodal element in the secant plane B-B.
Figure 5:
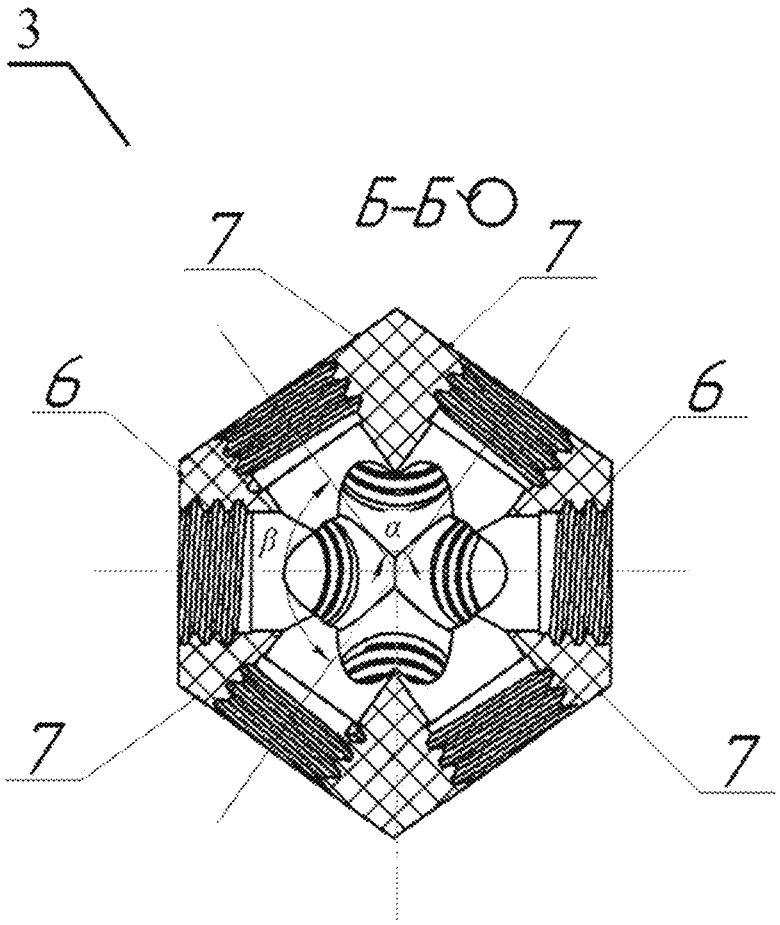
FIG. 5. Sectional view of the nodal element in isometry.

Six holes on square faces (6) form orthogonal vectors directed towards each other at a 90-degree angle (FIG. 4). Holes on adjacent hexagonal faces (7) form vectors directed towards each other at angles of $\pm 71^0$ ($\alpha$), and at angles of $\pm 109^0$ ($\beta$) on hexagonal faces (7) symmetrical about an axis passing through the center of the square face (6). Holes on adjacent faces in the form of squares (6) and hexagons (7) form vectors directed towards each other at angles of $\pm 54.5^0$ ($\beta/2$) (FIG. 5).

The sleeve (5) is prismatic with internal threading. Depending on the tools used, the sleeve (5) can have different specifications, such as a hexagonal, triangular, or rectangular shape in cross-section, preferably hexagonal. During manual assembly the faces of the sleeve serve to grip and prevent finger slippage.

The sleeve (5) is pre-screwed onto one end of the rod for its entire length. The sleeve (5) serves for sequential detachable connection of the rods (2), with the diameter of the external thread of the rod (2) corresponding to the diameter of the internal thread of the sleeve (5) (FIG. 1).

The space frame (1) can include hexagonal lock nuts (not shown in the drawings) to prevent unscrewing and eliminate play in the sleeve (5) during operation. The lock nuts are installed on both sides of the sleeve (5).

The materials used in the structural components are composite, lightweight, made from various materials with different characteristics depending on the requirements, and can be molded in injection moulding machines.

The components can be manufactured from both primary raw materials and regranulate (recycled materials, waste).

The components have relatively low weight and small dimensions, allowing them to be transported by any type of transport with low load capacity. The low weight is achieved not only by using the specified materials but also due to the truncated conical parts of the hole (4) in the nodal element (3), which remain empty after rods installation (2). The low weight and small geometric dimensions allow assembling bar frames from relatively small to infinitely large sizes and shapes. It is also possible to prepare assemblies, partial or complete frameworks (prefabricated) in advance.

The simplicity of assembly operations allows to use robots and manipulators to automate all processes from manufacturing to assembly, reducing labor costs and increasing speed.

People without special knowledge and tools can carry out assembly.

The assembly of the space frame is performed in the following sequence.

Pre-determine the dimensions and required number of rods (2) and nodal elements (3) to satisfy the condition of static determinacy of the structure. Bring the ends of the rods (2) to the threaded holes (4) of the nodal element (3) and screw them in. Tightening the screws until hard stop allows to obtain the necessary connection strength. Connect the rods (2) together using the sleeve (5) pre-installed at the end of the rod (2). If necessary to prevent unscrewing of the sleeve (5) and eliminate play, install and tighten the lock nuts.

Advantages of the claimed invention:

- the possibility of combining different materials with various characteristics;
- the possibility to reduce waste by using recycled materials;
- high-speed production of one-piece parts on an injection moulding machine;
- elimination of transportation issues by using any mode of transport;
- high assembly speed due to the simplicity of parts, small size, low weight, and threaded connections;
- minimization of labor costs;
- achieving any geometric dimensions due to scalability;
- architectural variety;
- the possibility of automation and robotization of production and assembly processes.

What is claimed is:

1. A space frame, comprising:

rods and nodal elements of polyhedral shape with threaded holes on the faces for fastening the rods; and a sleeve with internal threads, designed for detachable connection of the rods;

wherein the rods have a tubular cylindrical shape with external threads at the ends, and a diameter of each of the external threads matches a diameter of each of the threaded holes;

on faces in the form of squares, holes form vectors directed towards each other at an angle of 90°;

on adjacent faces in the form of hexagons, holes form vectors directed towards each other at an angle of ±71°;

on faces in the form of hexagons symmetrically with respect to an axis passing through a center of the square face, holes form vectors directed towards each other at an angle of ±109°; and on adjacent faces in the form of squares and hexagons, holes form vectors directed towards each other at an angle of ±54.5°.

2. The space frame according to claim 1, wherein the sleeve is prismatic.

3. The space frame according to claim 1, wherein the space frame further comprises hexagonal lock nuts on both sides of the sleeve.

4. The space frame according to claim 1, wherein the nodal elements have fourteen faces, six of which are square, and the remaining eight faces are hexagonal.

5. The space frame according to claim 4, wherein the remaining eight faces are having equal angles and different side lengths.

6. The space frame according to claim 1, wherein the space frame is made of composite materials.

* * * * *